US005515975A

United States Patent [19]

Jarvis et al.

[11] Patent Number: 5,515,975

[45] Date of Patent: May 14, 1996

[54] EVACUATED, ENCAPSULATING PACKAGING

[75] Inventors: David C. Jarvis; Judith A. Jarvis, both of Medinah, Ill.

[73] Assignee: Jarvis Packaging and Designs, Inc., Oswego, Ill.

[21] Appl. No.: 183,632

[22] Filed: Jan. 19, 1994

Related U.S. Application Data

[63] Continuation of Ser. No. 972,262, Nov. 5, 1992, abandoned.

[51] Int. Cl.[6] ..... B65D 81/02

[52] U.S. Cl. ..... 206/584; 206/523; 206/524.8; 206/459.5

[58] Field of Search ..... 206/523, 524, 206/584, 524.8, 459.5; 5/450; 53/408, 434, 512

[56] References Cited

U.S. PATENT DOCUMENTS

| | | | |
|---|---|---|---|
| 2,629,698 | 2/1953 | Sterling | 206/524 |
| 2,649,958 | 8/1953 | Rausch | 206/584 |
| 2,895,603 | 7/1959 | Freeman | 206/524 |
| 3,199,689 | 8/1965 | Feldkamp | 214/10.5 |
| 3,238,599 | 3/1966 | Baum | 29/91.1 |
| 3,255,871 | 6/1966 | Butler | 206/459.5 |
| 3,412,521 | 11/1968 | Bauman | 206/523 |
| 3,415,364 | 12/1968 | Schneider | 206/524 |
| 3,462,027 | 8/1969 | Puckhaber | 214/10.5 |
| 3,503,177 | 3/1970 | Kropscott et al. | 206/524 |
| 3,515,267 | 6/1970 | La Rocca et al. | 206/46 |
| 3,611,455 | 10/1971 | Gottfried | 5/450 |
| 3,762,404 | 10/1973 | Sakita | 128/78 |
| 4,154,344 | 5/1979 | Yenni, Jr. et al. | 206/328 |
| 4,162,729 | 7/1979 | Kaiser et al. | 206/586 |
| 4,213,213 | 7/1980 | Burnett | 5/450 |
| 4,566,831 | 1/1986 | Groth | 410/117 |
| 4,880,119 | 11/1989 | Simon | 206/584 |
| 4,885,811 | 12/1989 | Hayes | 5/450 |
| 4,937,131 | 6/1990 | Baldacci et al. | 428/131 |
| 5,009,318 | 4/1991 | Lepinoy | 206/524.8 |
| 5,071,009 | 12/1991 | Ridgeway | 206/586 |
| 5,079,787 | 1/1992 | Pollmann | 5/450 |
| 5,091,229 | 2/1992 | Golike et al. | 206/524 |
| 5,129,519 | 7/1992 | David et al. | 206/524.8 |
| 5,316,149 | 5/1994 | Tate | 206/584 |

FOREIGN PATENT DOCUMENTS

| | | | |
|---|---|---|---|
| 2659299 | 9/1991 | France | 206/584 |
| 1606385 | 11/1990 | U.S.S.R. | 206/524 |

*Primary Examiner*—David T. Fidei

[57] ABSTRACT

A sealed pliable bag, or pillow, containing loose particles is adapted for evacuation by means of a valve or by an air tube inserted through the bag which may be heat sealed upon subsequent withdrawal of the air tube. The particle filled bag is placed in contact with an article to be packaged so as to conform with the size and shape of at least a portion of the article and the bag is evacuated. One or more additional particle-filled bags are positioned over a remaining portion of the article and are similarly evacuated. Upon evacuation, the bags undergo a size reduction and become rigid, defining a hollow space conforming to the size and shape of the packaged article with the bags serving to protect the article when positioned in a closed container. In another embodiment, air may be introduced into the bags, each having a block-like shape, after the bags and the article are positioned in the closed container such as by puncturing or by means of a valve, allowing the bags to expand outwardly against the inner surface of the closed container and inwardly so as to securely engage the packaged article and provide secure, impact-resistant and shock-proof protection for the article within the container. Air-filled, compressible particles may be used in the bags permitting greater size reduction upon evacuation and increased expansion of the bag and particle combination upon inflation for more secure engagement of the article and the inner surface of the closed container.

10 Claims, 3 Drawing Sheets

EVACUATED, ENCAPSULATING PACKAGING

This is a continuation of application Ser. No. 07/972,262, filed Nov. 5, 1992, now abandoned.

FILED OF THE INVENTION

The invention relates generally to packaging of an article in a closed container such as a box for shipping or storage and is particularly directed to a packaging liner which securely engages an inner surface of a closed container while tightly encapsulating an article disposed in the container for protecting the article from impact damage.

BACKGROUND OF THE INVENTION

Delicate articles placed in a container such as a cardboard box for shipment or storage are generally disposed within a protective cushioning material. The protective material isolates the article from large forces and shocks which may occur due to rough handling of the container. The packaging liner may take various forms.

One form of packaging liner makes use of trapped air in sealed pockets of a sheet-formed plastic material, where the pockets of trapped air are disposed intermediate the packaged article and the inner walls of the container. Commonly used "bubble pak" is one example of the use of trapped air in a packaging liner. Another example of this type of trapped-air liner is disclosed in co-pending application, Ser. No. 728,231, assigned to the assignee of the present application. In some cases, air-filled particles, or beads, may be provided within the pockets of confined air. One example of this latter approach can be found in U.S. Pat. No. 3,515,267.

Another approach for protecting sensitive, fragile articles during shipping or storage employs a foam-in-place technique wherein the outer surface of the article is covered with a surface film, followed by pouring of a liquid foam into the open container and about the article. As the foam cures, it expands, adhering to the inner surfaces of the container enclosing the packaged article and filling up the space between the article and the container. Problems have been encountered in this approach. For example, expansion of the foam about the article sometimes results in damage to the article, such as implosion of a cathode ray tube (CRT) screen, or in leakage of the foam around the film where the film does not completely cover the article. In addition, the foam adheres to the container's inner walls, precluding recycling or subsequent use of the container. This approach is also labor intensive and thus expensive and is environmentally undesirable because of the hazardous fumes emitted by the foam prior to curing. Finally, the foam is typically polyurethane which is not biodegradable and thus presents a disposal problem.

Another packaging technique involves depositing a large number of the aforementioned air-filled particles, which are commonly referred to as "peanuts" or "popcorn", into an open container housing the article to be packaged. The particles surround the article and the container is sealed. It is difficult to determine the proper number of particles for deposit in the container for optimum protection and the loose particles are difficult to handle, generally requiring a cleanup effort after the container is sealed. During handling, the particles within the container are re-distributed and tend to settle toward the bottom of the container resulting in the formation of air pockets and at least a portion of the packaged article being unprotected. In order to avoid settling, or nesting, of the loose particles, another more recent approach involves spraying a light tacky glue onto the particles as they are deposited into the container. The sprayed collection of particles forms a rigid mold about the article which is difficult to remove from the article as well as from the container because of its tackiness. If the container is shipped before the glue is allowed to cure, the particles tend to become displaced resulting in unprotected areas, or voids, around the article in the container. This approach is messy, requiring a protective layer over the packaged article, and results in the collection of particles adhering to the container's inner surface. This approach also is labor intensive.

The present invention addresses the aforementioned limitations of the prior art by providing an evacuated, encapsulating packaging liner for protecting an article within a closed container such as a cardboard box.

OBJECTS AND SUMMARY OF THE INVENTION

Accordingly, it is an object of the present invention to provide a crush resistant, impact protection liner for an article in a closed container.

It is another object of the present invention to provide a packaging liner for a closed container which assumes the shape of the outer surface of an article in the container while uniformly and securely engaging the container's inner surface in forming an encapsulating, protective layer about the article.

Yet another object of the present invention is to provide an easy to use and install, environmentally safe and clean packaging liner which is adapted to tightly fit about and engage an article of virtually any shape and contour.

A further object of the present invention is to provide a packaging structure which is biodegradable, photodegradable and recyclable.

A still further object of the present invention is to provide a packaging liner which employs loose fill particles in a sealed envelope which eliminates particle clean-up generally required with the use of such particles.

Another object of the present invention is to provide a packaging liner incorporating loose fill particles which completely fills the space around an article in a closed container to protect against damage during storage or shipping.

These objects of the present invention are achieved and the disadvantages of the prior art are eliminated by an apparatus disposed in a closed container and securely engaging an article in the container for protecting the article during storage and shipping. The packaging apparatus includes a plurality of sealed flexible bag-like envelopes, or bags, disposed about and in contact with the article. A plurality of loose particles are disposed in each of the envelopes. Provision is made for evacuating each of the envelopes for forming at least a partial vacuum in the envelopes with a recessed portion of each envelope engaging a respective portion of the article whereby the volume of the envelopes is reduced due to removal of air therefrom and each particle-filled envelope is converted from a loose, flexible structure to a compact, rigid structure, with the envelopes securely engaging and providing protection for the article. In one embodiment, the envelopes may be disposed completely around the article in an encapsulating manner. In another embodiment, the vacuum in the envelopes may be released such as by puncturing or pumping air into the envelopes when the article and the encapsulating envelopes are placed in the closed container, whereupon the envelopes expand inwardly to securely engage the article and outwardly to securely engage the closed container and provide protection for the article in the closed container. In yet another embodiment, air-filled, compressible particles may be used in the envelopes permitting greater reduction in size upon evacuation and increased expansion of the envelope and particle combination upon inflation for more secure engagement of the article and inner surface of the closed container.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

This invention contemplates an evacuated, encapsulating packaging liner including a plurality of flexible, sealed envelopes, or bags, each containing a plurality of lightweight, porous particles loosely disposed in the envelope. Each particle-filled envelope is sealed and placed in a container together with the article to be packaged. In one embodiment, a surface portion of the sealed envelope containing the loose particles may be formed in the shape of a recess for receiving and engaging the article to be packaged. The envelope is then evacuated, resulting in the contraction of the envelope in tight-fitting engagement about the article. The evacuated bags and encapsulated article may then be positioned in a closed container for protecting the article during shipping or storage or the article may be removed from the evacuated envelope, permitting the envelope to be later used with another similar article in a closed container. With the envelopes positioned in the closed container and engaging the article in an encapsulating manner, another embodiment of the invention contemplates introducing air into the envelopes, allowing the envelopes to expand and to firmly engage the container's inner walls as well as the packaged article for protecting the article from damage by an impact force, shock or vibration. Air may be introduced either by pumping air into the envelopes or by merely puncturing the envelopes, allowing atmospheric pressure to fill the envelopes. Following use of the envelopes to protect the packaged article, the envelopes may be re-used as conventional, unevacuated, packaging liners without requiring particle clean-up. Still another embodiment contemplates the use of porous, air-filled, compressible particles in the envelopes allowing for greater size reduction upon evacuation and increased expansion of the envelope and particle combination upon inflation for more secure engagement of the article and the inner surface of the closed container.

Figure 1:
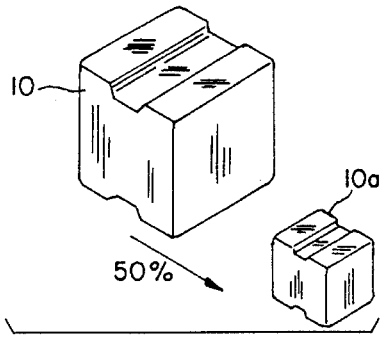
FIG. 1 is a perspective view of a porous, air-filled particle used in the evacuated, encapsulating packaging liner of the present invention showing the particle in normal size and in reduced size following evacuation of air from the particle.
Figure 2:
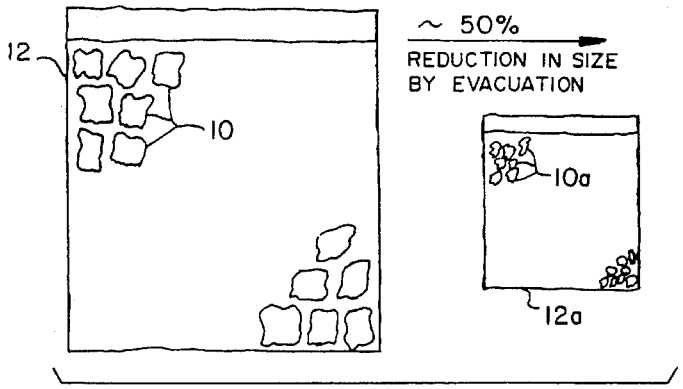
FIG. 2 is a simplified schematic diagram of a packaging liner including a plurality of porous, air-filled particles in accordance with the present invention showing the packaging liner and particles in a normal size as well as reduced in size when evacuated in accordance with the principles of the present invention.

Referring to FIG. 1, there is shown a perspective view of a porous, air-filled particle 10 used in the present invention. FIG. 2 is a simplified plan view of a flexible, closed envelope 12 containing a number of porous, air-filled particles 10 such as shown in FIG. 1 in accordance with the present invention. Particle 10 is a conventional packaging particle commonly known in the trade as "peanuts" or "popcorn" which is typically comprised of an expanded polystyrene (EPS), some versions of which are photodegradable, although virtually any type of air-filled particle which is compressible upon removal of the air therefrom could be used in the present invention. Other materials which could be used for particles 10 are polyurethane as well as various biodegradable materials such as corn starch or potato starch and water combinations.

Upon the application of a vacuum to a porous, air-filled particle 10 such as comprised of EPS, a reduction in particle size is realized. This reduction in size may be as great as 50%. Upon the application of a vacuum, the particle 10 not only is reduced in size, but also is converted from a soft, pliable material of relatively large volume to a rigid, hard, compact particle such as shown as element 10*a* in FIG. 1. Upon evacuation, the density of particles 10 is thus substantially increased with a corresponding reduction in size of the particle.

As shown in FIG. 2, a sealed envelope, or bag, 12 filled with loose particles 10 may also be reduced in size when evacuated. Thus, upon the application of a vacuum to sealed envelope 12 and porous, air-filled particles 10 therein, the size of the envelope and particles may be reduced by as much as 50% or more from its original dimensions.

Figure 3:
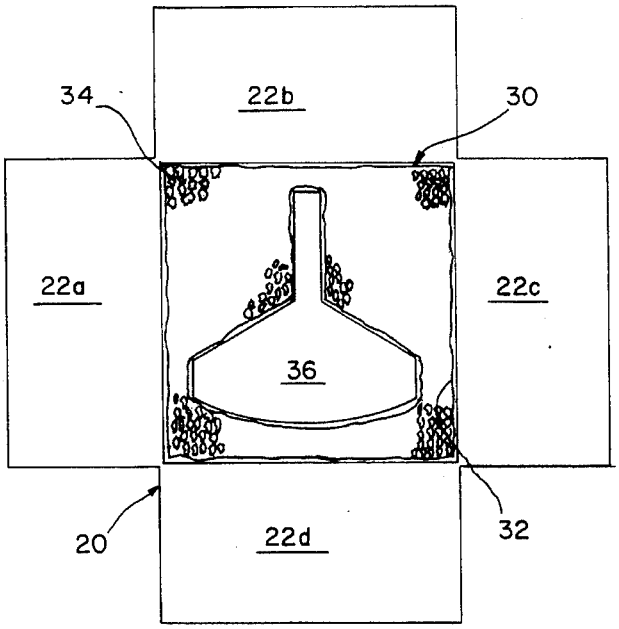
FIG. 3 is a top plan view showing an open container housing an article such as a cathode ray tube (CRT) partially encapsulated by a sealed envelope containing a plurality of particles in accordance with the present invention.
Figure 4:
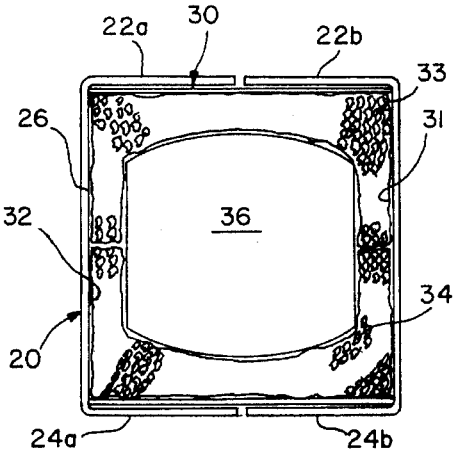
FIG. 4 is a sectional view of a closed container housing a CRT such as in FIG. 3, wherein the CRT is encapsulated by a pair of packaging liner envelopes containing a plurality of particles in accordance with the present invention.

Referring to FIGS. 3 and 4, there are respectively shown plan and sectional views of the manner in which a packaging liner 30 is employed in accordance with the principles of the present invention. An evacuated, encapsulating packaging arrangement in accordance with the present invention typically includes upper and lower sealed envelopes, or liners, 31 and 32. However, the present invention contemplates the use of a larger number of envelopes as dunnage to either completely or partially encapsulate the packaged article. The upper and lower envelopes 31, 32 are positioned in a container, such as a cardboard box, 20 having a continuous side wall 26, a plurality of foldable upper flaps 22*a*–22*d*, and a plurality of foldable lower flaps, where only two such flaps 24*a* and 24*b* are shown in FIG. 4. Lower envelope 32 is first positioned in container 20 and includes a recessed portion adapted for receiving an article to be packaged such as the CRT 36 shown in FIGS. 3 and 4. Upper envelope 31 similarly includes a recessed portion adapted for receiving an opposing surface of the CRT 36, such that the upper and lower envelopes 31, 32 securely engage and encapsulate CRT 36 as shown in FIG. 4. Each of the upper and lower envelopes 31, 32 includes a respective plurality of particles 33 and 34. The particles within each of the upper and lower envelopes 31, 32 are disposed intermediate and completely fill the space between CRT 36 and the inner walls of container 20. The packaging liner 30 comprised of the upper and lower envelopes 31, 32 thus protects CRT 36 from shock, impact forces and vibration. The manner in which the packaging liner 30 is deployed within container 20 so as to completely encapsulate CRT 36 is described in the following paragraphs.

Figure 5:
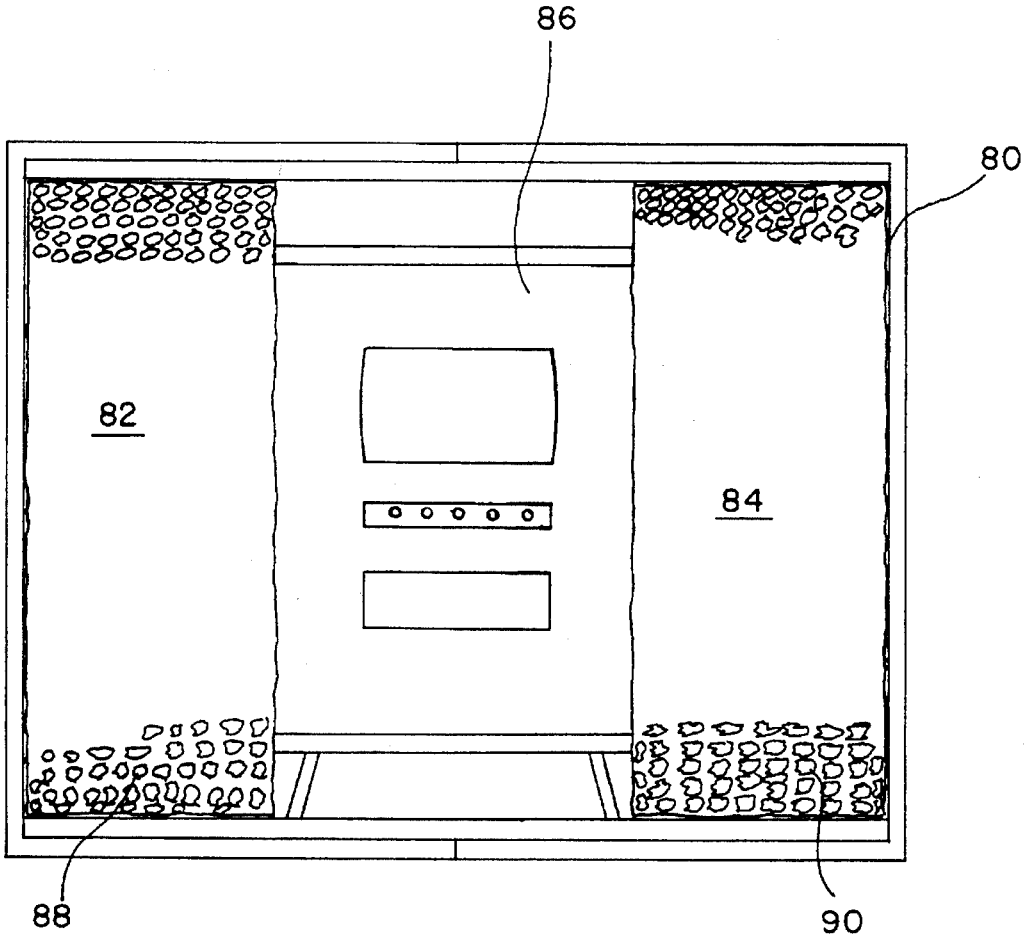
FIG. 5 is a sectional view of a pair of evacuated, particle-filled envelopes engaging opposed end portions of an article in a closed container in accordance with another embodiment of the present invention.

FIG. 5 shows an article 86, such as a television receiver, disposed in a closed container 80 and in contact with first and second evacuated envelopes 82 and 84, each in the form of a rigid body and each containing particles 88 and 90, respectively, in accordance with another embodiment of the present invention.

Referring to FIGS. 6–12, there are shown various steps in carrying out the evacuated, encapsulating packaging approach of the present invention. Referring to FIG. 5, there is shown the first step involving filling envelope 32 with a plurality of porous, air-filled particles 34 by means of a particle dispenser 40. Envelope 32 may be transparent and is comprised of a flexible, air-tight plastic material such as low or high density polyethylene for maintaining a vacuum within envelope 32 as described below. An upper portion of envelope 32 preferably includes a fill line 38 (shown in dotted-line form) for indicating the extent to which the envelope is to be filled with particles 34. Once the particle level reaches fill line 38, particle dispenser 40 is turned off, or removed, and no more particles are deposited within envelope 32. Envelope 32 also preferably includes packaging liner use indicia 42 indicating the size of the container as well as the type of article to be packaged within the container with which a particular envelope is to be used. In the example set forth in FIG. 5, envelope 32 is indicated for use in packaging a 25" CRT in a 3'×3'×3' closed container. The use of fill line 38 in combination with the liner use indicia 42 facilitates matching a given envelope with a given container and packaged article combination to ensure that the liner and particles completely fill the space around the article for maximum protection.

Figure 6:
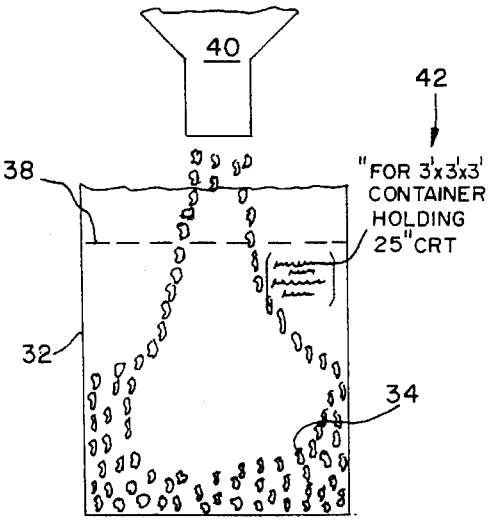

Following deposit of the porous, air-filled particles 34 within envelope 32, the envelope is sealed such as by heat sealing plates 28 as shown in simplified schematic diagram form in FIG. 6. The seal formed along an edge of envelope 32 is impervious to gases such as air, as well as to liquids and vapor. Although a heat sealing plate 28 is shown sealing envelope 32 in FIG. 6, various conventional sealing arrangements could be employed to seal the envelope in carrying out the principles of the present invention.

Figure 7:
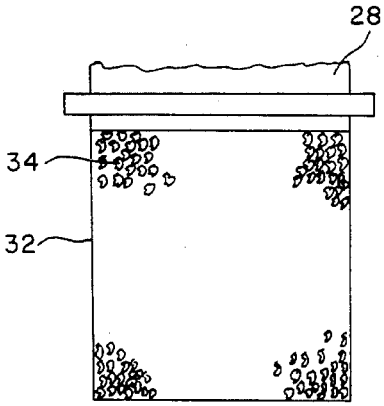
FIGS. 6–12 show various steps in encapsulating an article such as a CRT within a pair of evacuated, particle filled envelopes in a sealed container in accordance with the present invention.

After envelope 32 is sealed with particles 34 disposed therein, the envelope is positioned within a reference container 46 which is open at the top as shown in FIG. 7. The inner length and width of container 46 is preferably larger than the inner length and width of the container in which CRT 36 is to be packaged, while the height of the reference container is typically on the order of one-half (½) the height of the container in which the CRT is to be packaged. A recess 52 is then made within an upper portion of envelope 32 so as to accommodate a lower portion of CRT 36. Recess 52 is easily formed within an upper portion of envelope 32 because the particles 34 are loosely packed within the envelope and move freely over one another as well as along the inner surface of the envelope.

Figure 8:
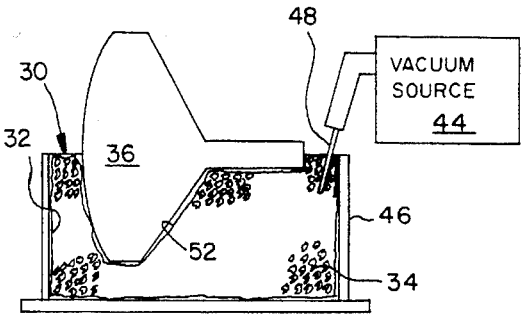

After positioning CRT 36 within recess 52 formed in envelope 32, the envelope is then evacuated by means of a vacuum source 44. Vacuum source 44 may be conventional in design and operation and typically includes a compressor and is shown coupled to envelope 32 by means of an evacuating needle 48. A valve (not shown) integral with envelope 32 may also be used to evacuate the envelope. As shown in FIG. 8, evacuation of envelope 32 by means of the vacuum source 44 causes the particles 34 within the envelope as well as the envelope itself to decrease in size and to become disposed in intimate contact with a lower periphery of CRT 36. With envelope 32 evacuated of air, the evacuated particles 34 form a rigid matrix structure about a lower portion of CRT 36. Recess 52 within envelope 32 closely conforms with and engages the lower surface contour of CRT 36.

Figure 9:
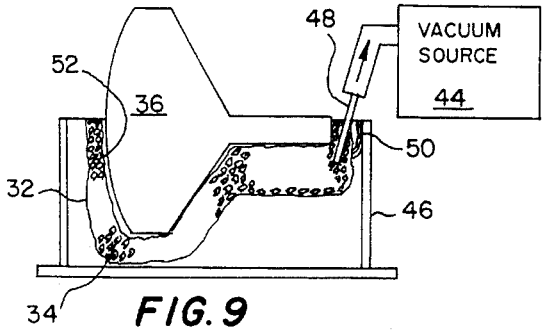
Figure 10:
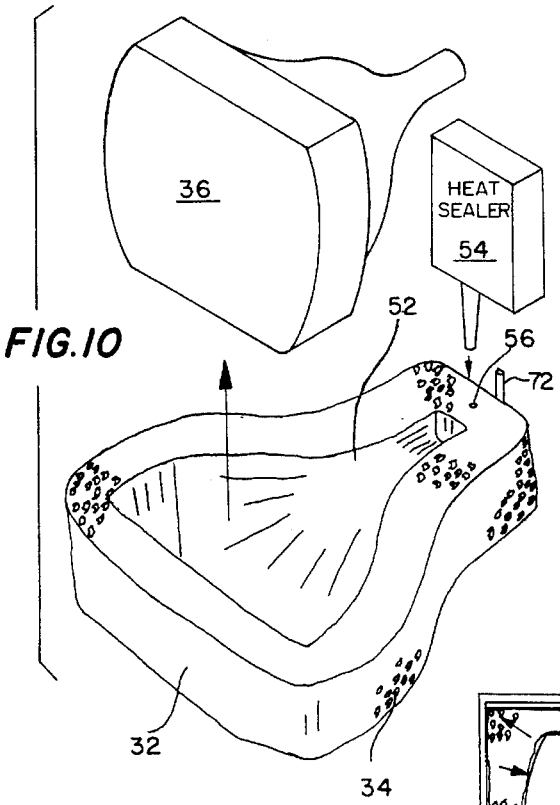

As shown in FIG. 9, the CRT 36 is then removed from recess 52 within an upper portion of the evacuated envelope 32. When evacuating needle 48 is removed from envelope 32, the thus formed aperture 56 in the envelope may be sealed off to prevent the introduction of air into the envelope by means of a conventional heat sealer 54. As shown in FIG. 9, once evacuated, the recess, or depression, 52 in the upper surface of envelope 32 conforms very closely to the lower periphery of CRT 36. Recess 52 maintains this shape so long as envelope 32 is evacuated. Envelope 32 may be provided with a valve 50 as shown in FIG. 8 for removing air from the envelope as an alternative to employing needle 48 and heat sealer 54.

The next step involves the positioning of upper and lower packaging liner envelopes 62 and 66 within an open box-like container 58 with the CRT 36 disposed within the joined envelopes in an encapsulating manner. This is shown in the sectional view of FIG. 10, where the upper and lower packaging liner envelopes 62, 66 include respective pluralities of small, evacuated, rigid particles 64 and 68. Container 58 includes a plurality of upper folding flaps **60*a*, 60*b* and 60*c*, which are closed once the upper and lower packaging liner envelopes 62 and 66 and CRT 36 are disposed within the container. Air is then introduced into the upper and lower packaging liner envelopes 62, 66 after container 58 is closed and sealed. Air may be introduced into the upper and lower packaging liner envelopes 62, 66 by means of respective valves 70 and 72 extending through apertures within the side wall of container 58. Rather than extending valves 70 and 72 through respective apertures in the side wall of container 58, another embodiment contemplates extending the two valves upward and through a gap between one of the aforementioned upper folding flaps and an upper edge of the container's side wall. Finally, air may be introduced into the upper and lower packaging liner envelopes 62, 66 once container 58 is closed by merely piercing these envelopes with a sharp object such as a needle. The lower envelope 66 may be pierced with the container open. As the bottom envelope inflates, the upper envelope 62 is positioned in open container 58 and also pierced. As the upper and lower envelopes 62, 66 expand during inflation, the container 58** is sealed closed.

Figure 11:
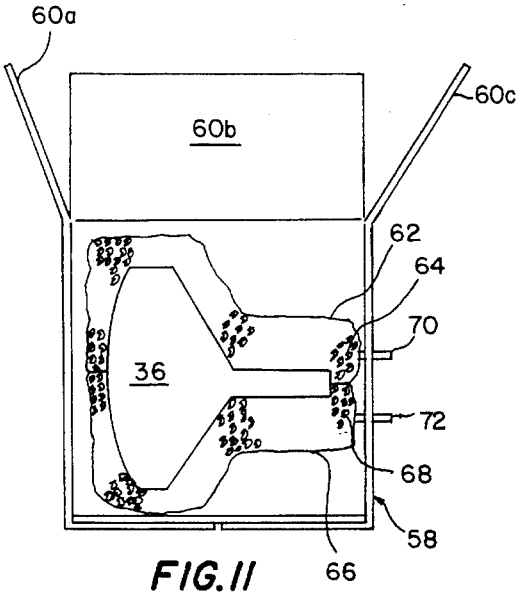
Figure 12:
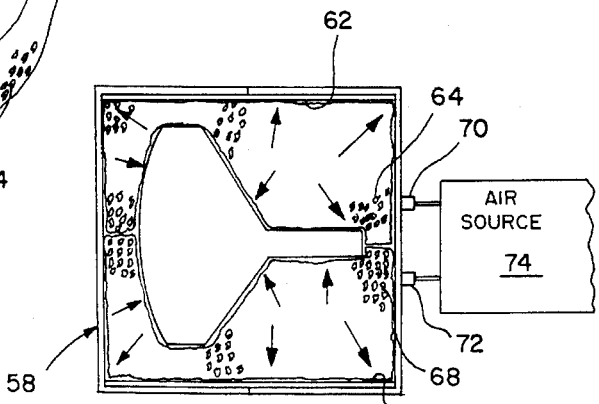

Referring to FIG. 11, there is shown a simplified schematic diagram of air being introduced into the upper and lower envelopes 62, 66 by means of an air source 74 coupled to valves 70 and 72. Air source 74 may be a compressor or may merely be a source of atmospheric pressure such as the ambient environment. The air source 74 is shown coupled to the upper and lower envelopes 62 and 66 by means of respective valves 70 and 72. In the alternative, the two evacuated envelopes may be merely pierced with a sharp object such as a needle to permit introduction of air into the envelopes, as mentioned above. As shown in FIG. 11, when air is introduced into the upper and lower envelopes 62, 66, the envelopes expand inwardly about CRT 36 and outwardly in contact with the inner surface of container 58. The upper and lower envelopes 62, 66 expand until the entire volume of space between CRT 36 and the inner surface of container 58 is filled with the expanding upper and lower envelopes as well as with the respective particles 64, 68 therein.

There has thus been shown an evacuated, encapsulating packaging liner including a plurality of sealed pliable envelopes, pillows or bags, each containing a large number of loose particles where the envelopes are adapted for evacuation. The particle-filled, evacuated envelopes may be used to fill the space in a closed container about an article to protect the article. In another embodiment, a recess may be formed in a surface of the particle-filled envelope conforming to the size and shape of an article to be packaged and the envelope is evacuated resulting in removal of air from the particles and a reduction in size of the envelope about a surface portion of the article. Upon evacuation, the envelope and particle combination is converted from a loose structure to a rigid body tightly encapsulating at least a portion of the article. One or more similar evacuated envelopes are similarly disposed about the remaining portions of the article in an encapsulating manner. The evacuated envelopes and the article may then be placed in a closed container, or the article may be removed from the envelopes which retain their shape for later use in packaging a similarly sized and configured article. With the envelopes and article disposed in a closed container, air may be introduced into the envelopes either by piercing the envelopes with a sharp object such as a needle or by introducing air under pressure via a valve, allowing the envelopes to expand and completely fill the space between the packaged article and the closed container. Air-filled, porous, compressible particles may be used in the envelopes permitting greater size reduction upon evacuation and increased expansion of the envelope and particle combination upon inflation for more secure engagement of the article and the inner surface of the closed container. Upon expansion with the introduction of air, the particles become less rigid and more compressible to provide an increased cushion-effect. The expanded envelopes and particles provide secure, impact-resistant and shock-proof protection for the article within the container.

While particular embodiments of the present invention have been shown and described, it will be obvious to those skilled in the art that changes and modifications may be made without departing from the invention in its broader aspects. Thus, while the present invention has been described for use in packaging a CRT, it is not so limited and may be employed with virtually any type of article regardless of shape, configuration or composition. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. Apparatus disposed in a closed container and securely engaging an article in said container for protecting said article during storage and shipping, said apparatus comprising:

a plurality of sealed, flexible envelopes, each of said envelopes having a respective outer surface for engaging a portion of the articles, wherein the size of each of said envelopes is determined by the size, shape and weight of the article and the dimensions of the closed container;

indicia on each of said envelopes indicating the dimensions of the container and the size and shape of the article with which said envelopes are intended for use;

a plurality loose particles disposed in each of said envelopes, wherein each envelope includes a fill line indicating the level to which each of said envelopes is to filled with said particles;

evacuation means in each of said envelopes for forming at least a partial vacuum in said envelopes with each of said envelopes engaging a portion of the article, whereby the volume of said envelopes is reduced due to removal of air therefrom and each particle-filled envelope is converted from a loose, flexible structure to a compact, rigid structure for protecting the article within the closed container, and wherein each of said envelopes retains its shape when removed from the container with the article and when the article is removed from the envelope for reuse with similarly sized and shaped articles;

wherein said particles are comprised of a porous, air-containing material, and wherein air is removed from said particles as well as from said envelopes when said at least a partial vacuum is formed in said envelopes to further reduce the volume of said envelopes and render each particle-filled envelope more rigid; and inflation means in each of said envelopes for releasing the vacuum in said envelopes when the article and said envelopes are placed in the closed container, whereupon said particles and envelopes expand inwardly to securely engage the article and outwardly to securely engage an inner surface of the closed container and provide protection for the article in the closed container.

2. The apparatus of claim 1 wherein said envelopes are comprised of flexible, thin plastic.

3. The apparatus of claim 2 wherein said flexible, thin plastic is polyethylene.

4. The apparatus of claim 1 wherein said envelopes are comprised of flexible, thin metal foil.

5. The apparatus of claim 1 wherein the number and size of said particles in each of said envelopes is determined by the size and shape of the article and the dimensions of the closed container.

6. The apparatus of claim 1 wherein said particles are comprised of expandable polystyrene.

7. The apparatus of claim 1 wherein said particles are comprised of polyurethane.

8. The apparatus of claim 1 wherein said particles are comprised of a food product including corn or potato starch.

9. The apparatus of claim 1 wherein said evacuation means and said inflation means are comprised of a single valve.

10. The apparatus of claim 1 wherein said evacuation means includes a valve and said inflation means includes a sharp pointed object for piercing said envelopes and allowing air to enter and expand each of said envelopes.

* * * * *